US006705252B2

(12) United States Patent
Lung et al.

(10) Patent No.: US 6,705,252 B2
(45) Date of Patent: Mar. 16, 2004

(54) VAPORIZER

(76) Inventors: Huang Chen Lung, 9F 3R. No. 210 Chung Hsueh Rd., Tainan City (TW); Huang Chuan Pan, 9F 3R, No. 210, Chung Hsueh Rd., Tainan City (TW)

( * ) Notice: Subject to any disclaimer, the term of this patent is extended or adjusted under 35 U.S.C. 154(b) by 0 days.

(21) Appl. No.: 10/157,471

(22) Filed: May 23, 2002

(65) Prior Publication Data

US 2003/0217705 A1 Nov. 27, 2003

(51) Int. Cl.[7] ..... F22B 27/08
(52) U.S. Cl. ..... 122/40; 392/399
(58) Field of Search ..... 122/4 A, 40, 235.29, 122/247; 392/394, 396, 397, 399, 400

(56) References Cited

U.S. PATENT DOCUMENTS 1,288,055 A * 12/1918 Langsenkamp ..... 165/162
2,535,752 A * 12/1950 O'Connell ..... 239/70
4,246,871 A * 1/1981 Bocksruker et al. ..... 122/4 A
5,058,194 A * 10/1991 Violi ..... 392/400
6,167,845 B1 * 1/2001 Decker, Sr. ..... 122/40

* cited by examiner

*Primary Examiner*—Gregory Wilson
(74) *Attorney, Agent, or Firm*—Pro-Techtor International Services

(57) ABSTRACT

A vaporizer includes a pump for pumping liquid stored in a liquid store tank, a helical vaporizing tube, and a control system connected to two ends of the vaporizing tube for functioning to make the vaporizing tube produce high temperature so as to heat up swiftly liquid flowing through the helical vaporizing tube and finally vaporize liquid at the outlet end of the vaporizing tube, with the liquid in the helical vaporizing tube never reversely flowing back to the pump owing to low temperature of liquid at the inlet end of the helical vaporizing tube.

2 Claims, 4 Drawing Sheets

VAPORIZER

BACKGROUND OF THE INVENTION

This invention relates to a vaporizer, particularly to one capable to speedily convey and vaporize liquid in a vaporizing tube.

A common conventional vaporizer generally includes a cast block 1 made of zinc-aluminum alloy and an electric heating tube 10 and a water conveying tube 11 both contained in the cast block 1. Then the case block 1 is heated up by the electric heating tube 10, and then the water conveying tube 11 is heated up by the heat of the cast block 1 so that liquid flowing in the water conveying tube 11 is also heated up to become vapor. The time required in vaporizing may be 2–3 minutes at least or more than ten minutes at latest depending on the capacity of the electric heating tube 10, as high temperature produced by the electric heating tube 10 has to be transmitted to the cast block 1 and the heat absorbed by the cast block 1 is then transmitted to the water conveying tube 11, whose heat is then absorbed by liquid flowing in the water conveying tube 11. Then the liquid in the tube 11 has to be boiled to become vapor. Therefore, if the liquid in the tube 11 is to be vaporized in two or three minutes, a large amount of electricity is needed to heat up swiftly the electric heating tube 10 in order to vaporize liquid in 2 or 3 minutes. Or liquid in the water conveying tube 11 has to be heated up by the heat absorbed by the water conveying tube 11 for more than ten minutes in case of the electric heating tube 10 having a small capacity, quite inconvenient to use.

The conventional vaporizer described above uses the electric heating tube 10 for indirectly heating liquid flowing through the water conveying tube 11, having inferior effect in vaporizing due to insufficient heat capacity so that liquid drops may remain at the outlet end of the water conveying tube 11, hardly meeting the using standard.

SUMMARY OF THE INVENTION

This invention has been devised to offer a vaporizer having better effect than the conventional ones.

The vaporizer in the invention has the following feature.

1. It includes a pump for pumping liquid to be conveyed to a helical vaporizing tube, which has its two ends connected to two output terminals of a power source of a control system, for vaporizing liquid in the vaporizing tube very swiftly.
2. The vaporizing tube in the invention is shaped helical, having the lowest temperature at an inlet end and the highest temperature at an outlet end, preventing the liquid from reversely flowing back to the pump due to a low pressure of the liquid at the inlet end of the vaporizing tube.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
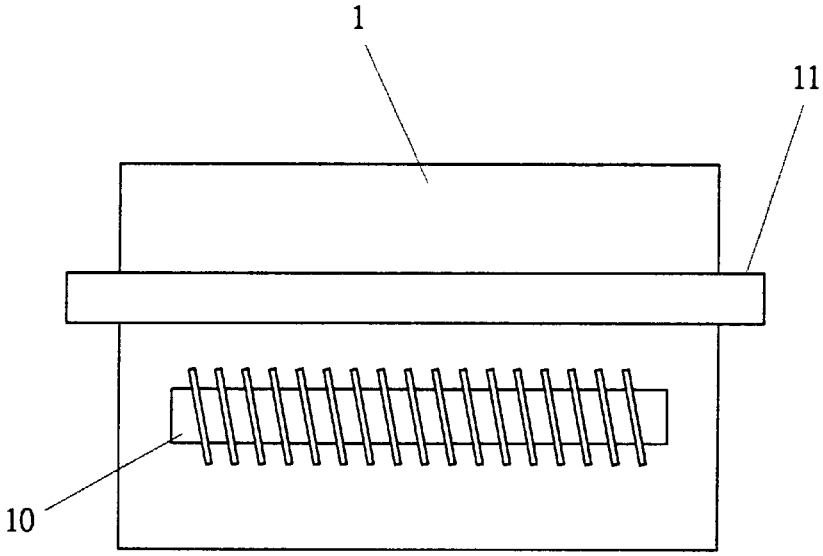
FIG 1 (PRIOR ART)
FIG. 1 is a side view of a conventional vaporizer.
Figure 2:
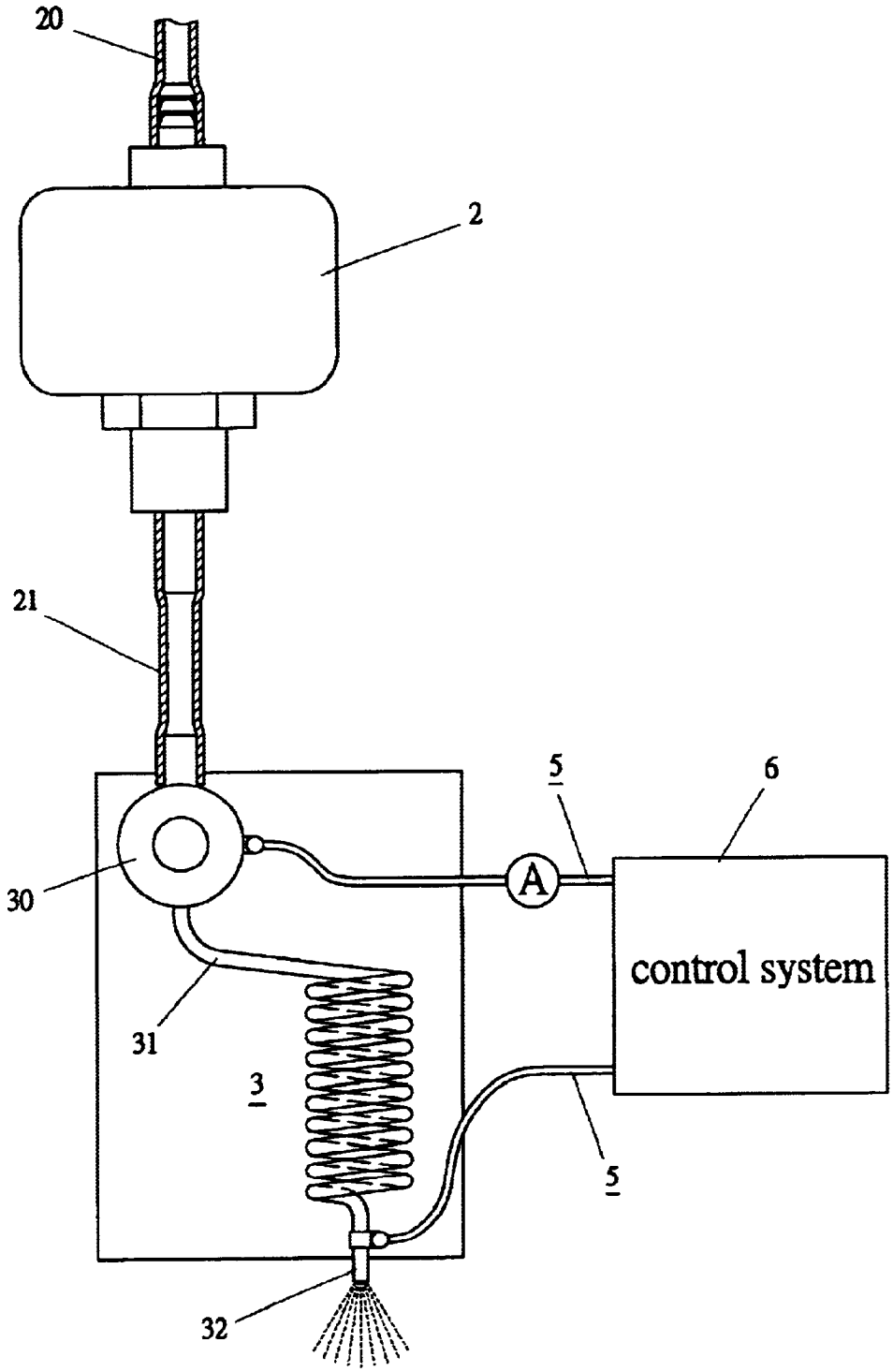
FIG. 2 is a perspective view of a vaporizer in the present invention.

A preferred embodiment of a vaporizer in the present invention, as shown in FIG. 2, includes a pump 2, an inlet tube 20 fixed on a side of the pump 2 for pumping in liquid in a liquid store tank (not shown), a vaporizing tube 3, and an outlet tube 21 provided between the pump 2, the vaporizing tube 3, a tube clamp 4, two leads 5, and a control system 6 as main components combined together.

Figure 3:
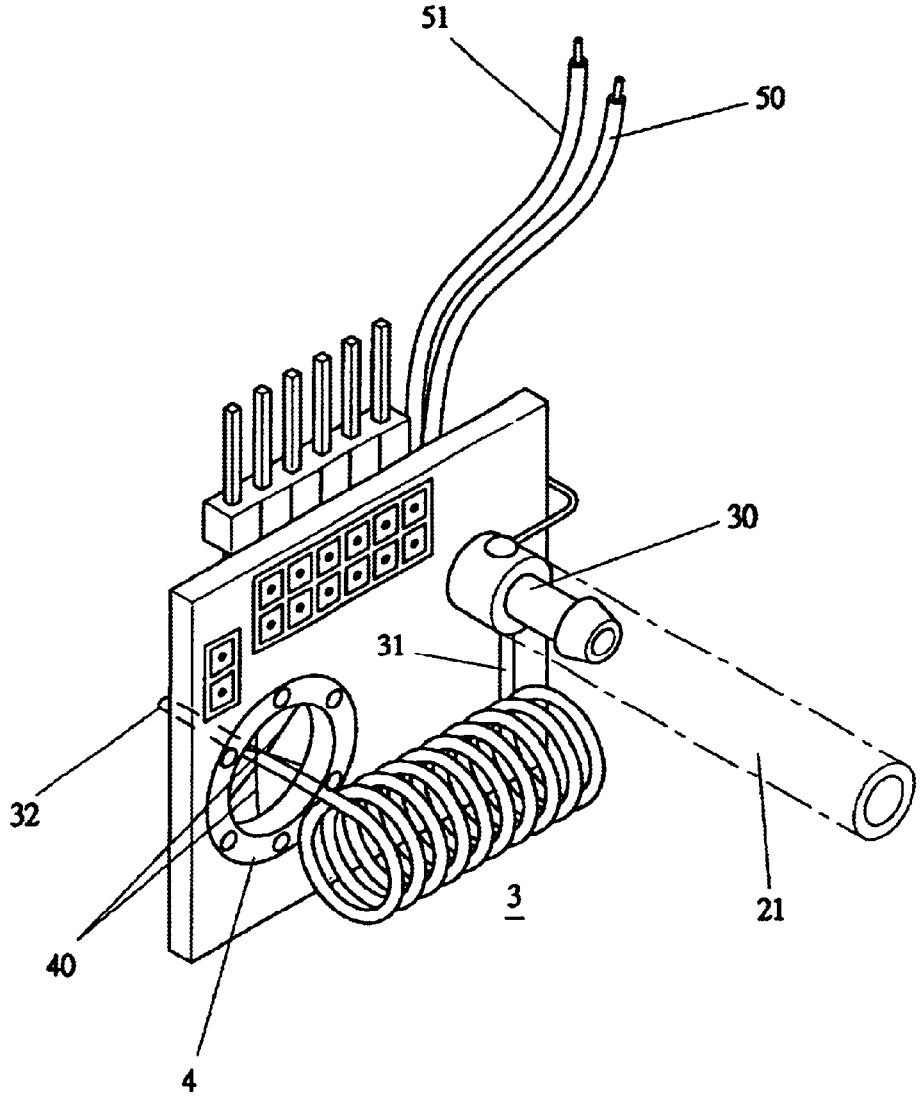
FIG. 3 is a perspective view of a vaporizing tube in the present invention; and, FIG. 4 is a perspective view of vapor produced by the vaporizing tube in the present invention.
Figure 4:
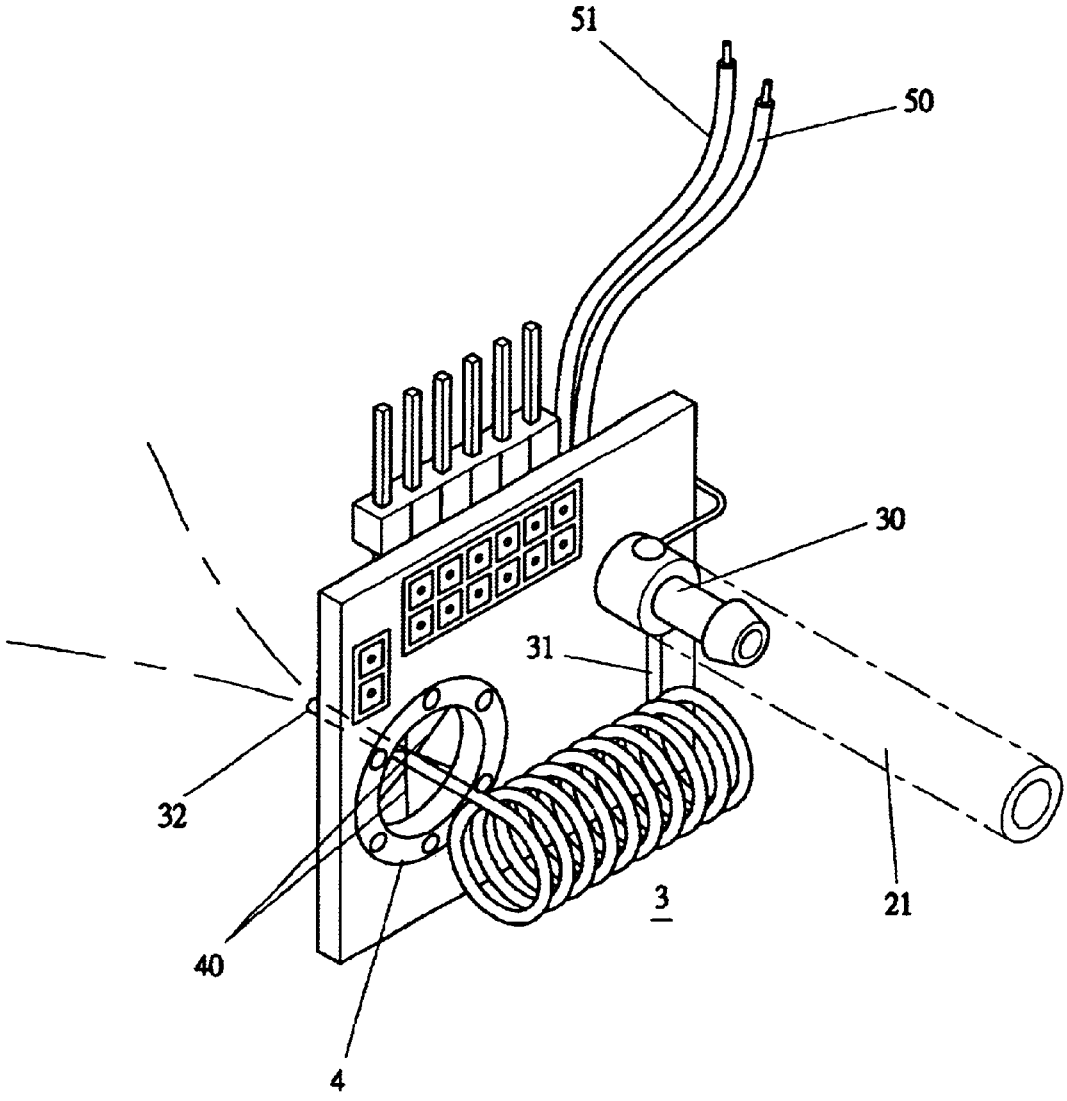

The vaporizing tube 3 is shaped helical, having an inlet end 31, an annular connect tube 30 connected to the inlet end 31, also connected to the outlet tube 21, and an outlet end 32 penetrating through a tube clamp 4 constituted of plural crossing leads 40, as shown in FIGS. 3 and 4. Then the two leads 50, 51 are respectively connected to the annular connect tube 30 and the tube clamp 4. Further the control system 6 for heating is connected to the annular connect tube 30 and to the tube clamp 4. When the control system 6 is handled to function through the leads 50, 51, then the vaporizing tube 3 produces immediately high temperature to heat up the liquid flowing through the vaporizing tube 3 so that the liquid becomes vapor to shoot out of the outlet end 32. Thus, when the vaporizer is powered, it produces vapor at once.

As much liquid flows in the helical vaporizing tube 3 and the pump 2 produces pressure for pushing forward the liquid in the vaporizing tube 3, vapor produced may be swiftly exhausted out of the outlet end 32. On the other hand, liquid of room temperature flows at first in the helical vaporizing tube 3 to keep the liquid in the inlet end 31 at the lowest temperature, increasing swiftly its temperature as it moves forward in the tube 3. Then the liquid may ultimately become vapor when reaching the outlet end 32. Moreover, the temperature at the inlet end 31 is maintained low, preventing liquid in the tube 3 from flowing back to the pump 2, and consequently keeping smooth forward flowing of liquid in the vaporizing tube 3. In addition, the vaporizer in the invention does not have problems of drops occurring or of imperfect vaporization.

While the preferred embodiment of the invention has been described above, it will be recognized and understood that various modifications may be made therein and the appended claims are intended to cover all such modifications that may fall within the spirit and scope of the invention.

What is claimed is:

1. A vaporizer comprising:

a pump having an inlet tube fixed on a side for pumping liquid stored in a liquid store tank, and an outlet tube connected to a vaporizing tube;

said vaporizing tube having an inlet end and an outlet end, said inlet end sand said outlet end respectively connected to two output terminals of a control system by means of two leads; and, said system function to make said vaporizing tube produce high temperature through said two output terminals and said two leads, liquid flowing in said vaporizing tube swiftly heated up by the high temperature of said vaporizing tube to become vapor at the outlet end of said vaporizing tube, said vaporizer having effect of immediately vaporizing liquid when powered.

2. The vaporizer as claimed in claim 1, wherein an annular connect tube is connected to the outlet tube of said pump and then connected to the inlet end of said vaporizing tube, and the outlet end of the vaporizing tube penetrates through a tube clamp constituting of plural crossing leads.

* * * * *